United States Patent [19]

Rohde et al.

[11] 4,357,866

[45] Nov. 9, 1982

[54] CALENDER FOR A TRAVELING WEB, SUCH AS A PAPER WEB

[75] Inventors: Günter Rohde, Konigsbronn-Zang; Christian Schiel, Heidenheim, both of Fed. Rep. of Germany

[73] Assignee: J. M. Voith GmbH, Fed. Rep. of Germany

[21] Appl. No.: 177,380

[22] Filed: Aug. 12, 1980

[30] Foreign Application Priority Data

Aug. 31, 1979 [DE] Fed. Rep. of Germany ..... 2935160

[51] Int. Cl.[3] ..... B30B 3/04

[52] U.S. Cl. ..... 100/162 R; 100/170

[58] Field of Search ..... 100/162 R, 170, 161, 100/168, 163 A, 167, 93 RP

[56] References Cited

U.S. PATENT DOCUMENTS

| | | | |
|---|---|---|---|
| 1,498,237 | 6/1924 | Daniels | 100/167 |
| 1,793,114 | 2/1931 | Minton | 100/163 A |
| 1,934,233 | 11/1933 | Malkin | 100/162 R |
| 3,731,620 | 5/1973 | Klemmer | 100/170 X |
| 4,206,700 | 6/1980 | Stotz | 100/170 X |

FOREIGN PATENT DOCUMENTS

| | | |
|---|---|---|
| 4656 | 4/1879 | Fed. Rep. of Germany . |
| 524743 | 9/1921 | France . |
| 189507 | 11/1922 | United Kingdom . |

*Primary Examiner*—Billy J. Wilhite

*Attorney, Agent, or Firm*—Ostrolenk, Faber, Gerb & Soffen

[57] ABSTRACT

A calender for a traveling web is disclosed. A frame includes an upper part and a lower part, the lower part having a pair of vertical arms at each end, and the upper part being connected to the upper end of the arms. Bearing brackets are disposed at each end of the frame, between the vertical arms at that end. At least two horizontal rollers are accommodated in the bearing brackets, substantially in a single vertical pressing plane. The bearing brackets are held in place by the vertical arms and the upper part of the frame. Preferably, the upper part of the frame itself serves as the bearing bracket for the upper roller, and the bearing brackets may be secured to at least one of the vertical arms at each end of the frame.

17 Claims, 4 Drawing Figures

CALENDER FOR A TRAVELING WEB, SUCH AS A PAPER WEB

BACKGROUND OF THE INVENTION

The present invention relates to a calender having at least two horizontal rollers arranged substantially in one pressing plane, which rollers are supported at both ends by bearing brackets held in a frame.

The pressing plane is the plane defined along the axial length of the rollers at which cooperating rollers are pressed together.

One such calender is known in which the individual rollers are supported in bearing housings which are held in a vertically displaceable manner in frame-like bearing brackets. The bearing brackets are fastened in vertically displaceable fashion on a common frame. By vertical movement of the lowermost roller the roller nips can be opened and closed. For this purpose, the individual bearing brackets have stops against which the bearing housings stop when the lowermost roller is lowered (German Unexamined Application for Patent Offenlegungschrift 23 20 519). One essential disadvantage of this arrangement is that changing the set of rollers is very time consuming. First, the bearers, scrapers, etc. and the cover plates of the bearing brackets must be removed. (German Application No. 23 20 519, however, does not show all the additional necessary apparatus such as scrapers, bearers, etc.) Finally, the rollers must be suspended from a hoist and be moved out and then in again horizontally, whereby unintentional damage can easily result from improper operation of the hoist. Furthermore, the known calender has a single-side heavy stand from which the roller supports are suspended. This construction not only is expensive, but it also occupies much space because of its wide stands. Moreover, the single-side stands may bend under a load, as a result of which vibrations can occur.

SUMMARY OF THE INVENTION

The principal object of the present invention is to create a calender of the aforementioned type which is inexpensive, compact, and low in vibrations and in which the set of rollers can be replaced particularly rapidly and simply without requiring the removal of supplementary devices such as scrapers, bearers, etc.

Another object of the invention is to provide the possibility of expanding a two-roller calender without great expense, for instance so as to form a four-roller calender, without having to provide a correspondingly high stand from the start.

A further object is to provide a calender which can be operated optionally with a different number of press nips so that an optimal finish can be obtained for each grade of paper produced.

According to the invention, a calender is provided in which a common frame having a U-shaped bottom part and a top part which connects together the two arms of the lower part serves as the bearing brackets at each end of the rollers. The bearing brackets are clamped between the transverse arms of the lower part and the upper part of the frame. In this connection, all the rollers except one are preferably movable relative to their bearing brackets in the vertical press plane. In this way, there is obtained a calender in which, upon the insertion of the rollers, the bearing brackets are simply stacked one on top of another in the U-shaped lower part of the frame and are clamped fast by means of the upper part.

As a result of this construction, the rollers can be replaced without complicated mounting work for the necessary auxiliary devices such as scrapers, blow nozzles, bearers, lifting gears, guide rolls, etc. After the removal of the upper part of the frame, the old set of rollers can be lifted out and the new set of rollers can be inserted from above. The auxiliary devices remain suspended from the lower part of the frame and are immediately again ready for use. Since there are no bending forces on the vertical columns, they can be made light, compact and nevertheless very resistant to the operating stresses, which arise from pure tensile forces.

All rollers of the stack are pressed against one roller which is supported immovably relative to the bearing brackets. The pressure is provided in a known manner by gravity and/or by an additional force, for instance a hydraulic cylinder. In this connection it is immaterial whether the non-displaceable roller is the lowermost roller, the uppermost roller or an intermediate roller. In most cases, however, it is most favorable, in accordance with one advantageous further development of the invention, to select the second roller from the bottom as the non-displaceable roller. The lowermost press nip can then open by itself as a result of gravity, and when the lower roller is a floating roller i.e., one that rotates about a stationary shaft, the non-displaceable second roller generally is driven from below and should therefore preferably be stationary. Furthermore, in such case the bearing forces on this stationary roller, which as a rule is not a floating roller, are small.

The lower roller is preferably developed as a floating roller since the highest linear pressures occur in the lower press nip, and linear pressure plus the weight of the roller itself would very strongly stress a conventional roller support.

If, in accordance with one very advantageous further development of the invention, the bearing brackets of the upper roller are developed at the same time as the upper part of the frame, a very compact and simple construction is obtained. In this way, removal and installation of a separate frame upper part are unnecessary to change the set of rollers.

One particularly preferred embodiment of a calender having four rollers in which the non-movable roller is the second from the bottom is obtained if the upper roller is developed in a known manner as a floating roller. Such a calender is particularly versatile in its uses, simple, and inexpensive and can be opened and closed by only two hydraulic actuations. The linear pressure in two-roller nips are adjustable independently of each other and the web of paper can be smoothed optionally in one or in three nips. When it is desired to operate with only one press nip, the rollers which are not used are placed out of operation in a simple manner, as described below. Furthermore, substantial regulation of the linear pressure in the two upper press nips is possible.

If the calender is to be operated with only two rollers, the upper roller is lifted off. The journals of the upper roller are connected by a hanger, with some play, to the journals of the lower roller in such a manner that upon the lifting of the upper roller, the lower roller participates in a part of the stroke of the upper roller and thus comes out of engagement with the third roller, which is located below it. In this connection, when the upper roller is in a lowered position, the hangers are held out of contact with its rotating parts. In particular, the second roller from above, which as a rule is not a floating roller, will have a rotating journal. One could, to be sure, connect the hanger support with the journal, but it is simpler and cheaper to omit this support. If the upper roller is a floating roller, the hangers can always lie on its journal, since this journal is stationary. If the journal of this roller rotates, however, then the hangers, when this roller is in its lowered condition, are so received in a holder that they also do not scrape against this journal.

In order to facilitate the installation and removal of the set of rollers, it is advisable to leave some space laterally between the corresponding bearing bracket and the vertical arms of the lower part of the frame. In order to increase the rigidity of the structure, in addition to clamping the bearing brackets between the upper and lower parts of the frame, they are in this case also fastened to one of the vertical arms of the lower part of the frame, for instance by bolts.

Other objects and features of the invention will be apparent from the following description and accompanying drawings. It is to be understood, however, that the invention is not limited to the precise arrangements and instrumentalities shown.

DETAILED DESCRIPTION OF THE PREFERRED EMBODIMENTS

Figure 1:
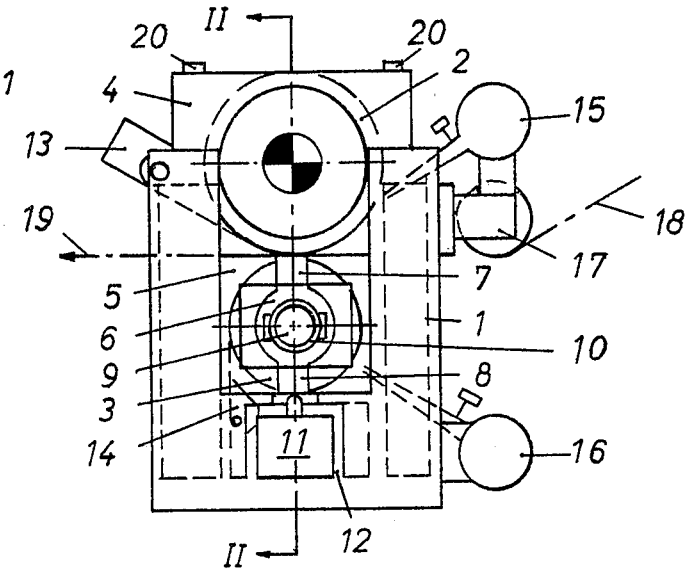
FIG. 1 shows a side view of a two-roll calender according to the invention.
Figure 2:
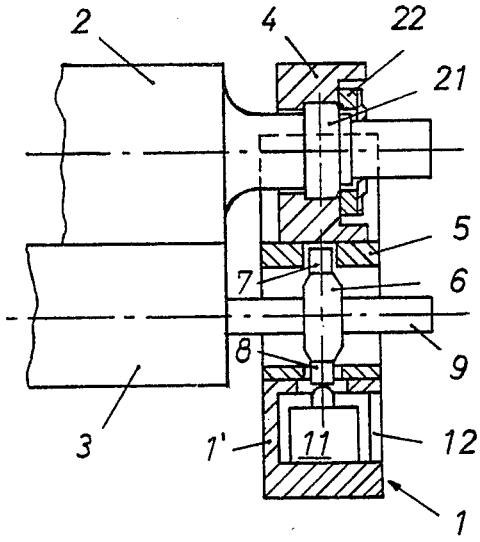
FIG. 2 is a section through the mounting of the calender of FIG. 1, seen along the line II—II.

In the two-roller calender shown in FIGS. 1 and 2, one end of the calender as shown, the other end having the same features. The rollers 2 and 3 are supported in bearing brackets 4 and 5, respectively, which are mounted in a U-shaped lower part 1 of a frame. The lower part of the frame has two U-shaped parts, the one shown in FIG. 2 and the one, not shown, at the other end of the rollers 2 and 3. The upper bearing bracket 4 is also the upper part of the frame, and it connects the two arms of the lower part 1 of the frame. The bearing bracket 4 which forms the upper part of the frame is fastened by bolts 20 to the lower part 1 of the frame. The bearing housing 6 of the roller 3 can move upward and downward with cylindrical guides 7 and 8 within the bearing bracket 5. In the alternative, the roller 3 can be a floating roller. In the latter case the shaft 9 of the roller 3 does not rotate. The illustrated shaft 9 of FIGS. 1 and 2 is supported by means of a ball box 10 in the bearing housing 6. The bearing housing 6 is movable up and down by means of a hydraulic cylinder 11 mounted in the lower part 1 of the frame. The upper roller 2 is supported by an anti-friction bearing 21. The anti-friction bearing chamber is closed by bearing lids 22. A window 12 is provided in the transverse beam 1' of the lower part 1 of the frame for installing the hydraulic cylinder 11 therein. Scrapers 13 and 14 are mounted on the lower part 1 of the frame. Cooling-air nozzles 15 and 16 are also mounted on the lower part 1 of the frame. Scraper 13 and air nozzle 15 are associated with the upper roller 2, while scraper 14 and air nozzle 16 are associated with the lower roller 3. In the same manner, guide rollers 17 are fastened to the lower part 1 of the frame, as are any transverse bearers required (not shown), as well as other necessary conventional devices. The web of paper to be treated travels at 18 under the guide roller 17 into the calender and emerges from the calender at 19.

Figure 3:
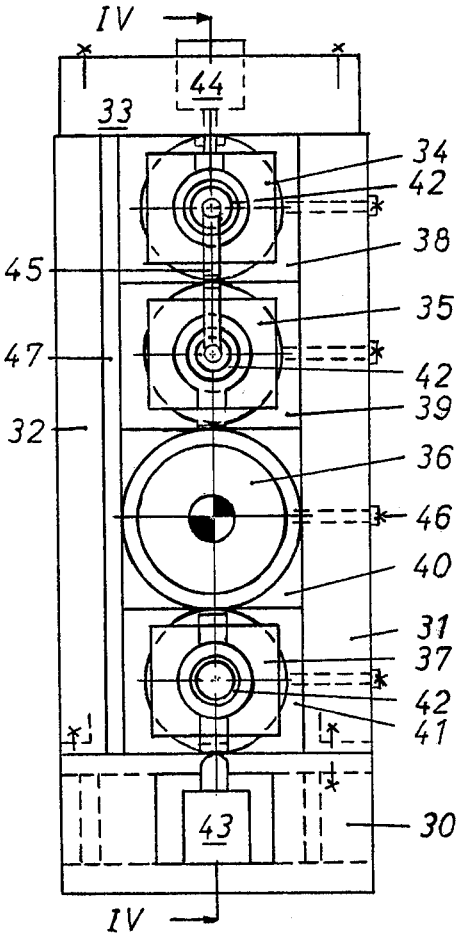
FIG. 3 is a side view of a four-roll calender according to the invention.
Figure 4:
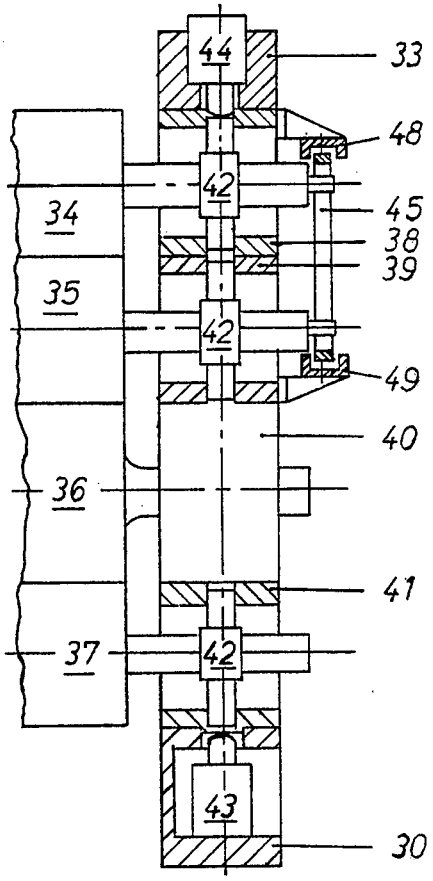
FIG. 4 is a cross-section through the mounting of the calender of FIG. 3, seen along the line IV—IV.

In the embodiment of a four-roller calender shown in FIGS. 3 and 4, only the main parts are shown. Again, only one end is shown, the other end having the same features. Scrapers, blow nozzles, etc., are omitted for the sake of clarity. The lower part of the frame is comprised of the transverse beam 30 and the columns 31 and 32. The columns are connected by an upper transverse beam 33. In this frame, the four rollers 34, 35, 36 and 37 are supported by means of bearing brackets 38, 39, 40 and 41, respectively. The bearing brackets 38–41 are stacked on top of each other and are held in position against upward displacement by the upper transverse beam 33. The upper transverse beam 33 is detachably connected by bolts (not shown) to the columns 31 and 32. The roller 36 (the second roller from the bottom) is mounted in the bearing bracket 40 for rotation, but not translation, with respect to the frame. The rollers 34, 35 and 37 are guided for vertical translation in bearing housings 42 within their respective bearing brackets 38, 39 and 41. The lower roller 37 can be moved vertically by a lift cylinder 43 and pressed against the adjacent roller 36. In this connection a form-locked or interengaging coupling joining the roller 37 to the bearing housing 42 is not required because the force of gravity is sufficient to lower the roller 37 after it has been raised. The lift cylinder 43, which is supported in transverse beam 30, acts only on one end of roller 37. Inherently, the weight of the roll on the lift cylinder 43 will lower them. A second hydraulic cylinder 44 is arranged in the upper transverse beam 33. The piston rod of hydraulic cylinder 44 is connected in a form-locked or interengaged manner with the bearing housing 42 of the upper roller 34 for lifting and lowering roller 34 and for pressing it downward. A hanger 45 is provided at each end of roller 34, and the hanger extends between the journals of the rollers 34 and 35. By means of the hanger 45, the roller 35 can be raised from the roller 36 when the roller 34 is raised by the hydraulic cylinder 44. The bearing brackets 38–41 are detachably connected to the frame column 31 by bolts 46. In this way, it is possible to align the axes of the rollers exactly in the pressing plane. Between the bearing brackets 38–41 and the frame column 32 is an air space or gap 47 which prevents jamming when the rollers 34–37 are installed or removed. As can be seen from FIG. 4, holders 48 and 49 for the hangers 45 are secured to the bearing brackets 38 and 39. In the operating position of the rollers 34 and 35, the hangers 48 and 49 hold each hanger 45 in such a manner that it does not touch any rotating roller journal. The top and bottom rollers 34 and 37 are, in general, floating rolls, in which case the axes of the two rollers are stationary and only the surface of each roller 34 and 37 rotates.

In the embodiment of the rollers 34 and 37 in which the cylindrical surface of the rollers can be displaced vertically with respect to the axis in order to produce the lifting movement, the hydraulic cylinders 43 and 44 can be dispensed with. In this case, the hanger which is provided for the lifting of the roller 35 must be articulated to a part which moves together with the surface of the roller 34.

In the case of calenders having more than four rollers, the same principle of construction as shown in FIGS. 1 to 4 can be used. In this case, for instance, a hanger which is moved by the upper roller can be used to raise a plurality of rollers located below it or, when using another (floating) roller with a lift device as an intermediate roller, other intermediate rollers arranged below it can also be raised by means of an additional hanger.

The present invention may be embodied in other specific forms without departing from the spirit or essential attributes thereof and, accordingly, reference should be made to the appended claims, rather than to the foregoing specification, as indicating the scope of the invention.

What is claimed is:

1. A calender for a traveling web comprising:

two parallel frames, said frames each having a bottom part and each having one arm extending from the respective said bottom part;

bearing brackets secured in a stationary manner to each of said arms;

at least two rollers each having ends thereof, said rollers being arranged substantially in a press plane; said ends of said rollers each being accomodated in respective ones of said bearing brackets, each respective bearing bracket being secured to a respective one of said arms of said respective frames, one of said rollers being immovably fixed in said press plane relative to said bearing brackets and the other of said rollers being movable in said press plane relative to said bearing brackets for forming at least one press nip.

2. The calender of claim 1, further comprising:

bearing housings which accept said ends of said movable rollers and move therewith, said bearing housings being disposed within and movable in said bearing brackets.

3. The calender of claim 1, further comprising:

bearing housings which accept said ends of said movable rollers and move therewith, said bearing housings being disposed within said bearing brackets;

cylindrical guides extending from said bearing housings parallel to said press plane;

openings in said bearing brackets for accepting said cylindrical guides so as to permit said bearing housings and said movable rollers to move in said press plane.

4. The calender of claim 3, further comprising hydraulic cylinders mounted to said frame, each hydraulic cylinder having a portion acting upon a respective one of said cylindrical guides to move said bearing housings and said movable rollers.

5. The calender of claim 1 in which said bearing brackets are stacked one upon another.

6. A calender for a traveling web comprising:

two parallel frames, said frames each having a bottom part and having two arms extending from the respective said bottom part, said two arms forming a U-shape with said bottom part, said frame further including an upper part secured to said arms at a position remote from said bottom part;

bearing brackets between said two arms of each frame, said bearing brackets being stationary in said frames;

at least two rollers each having ends thereof, said rollers being arranged substantially in a press plane; said ends of said rollers being accomodated in respective ones of said bearing brackets, each in a respective one of said frames; one of said rollers being immovably fixed in said press plane relative to said bearing brackets and the other of said rollers being movable in said press plane relative to said bearing brackets for forming at least one press nip.

7. The calender of claim 6 in which said bearing brackets are stacked one upon another between said bottom part and said upper part of said frame; said bearing brackets being clamped between said bottom part and said upper part of said frame.

8. The calender of claim 6 in which said frames have a common bottom part having first and second ends, two said arms extending from each respective said end to form said U-shape.

9. The calender of claim 1, 6 or 7 wherein the said bearing brackets of the uppermost said horizontal roller are continuous and integral with said upper part of the frame.

10. The calender of claim 6 or 7, wherein said bearing brackets are secured at each said end of said frame to at least one said vertical arm.

11. The calender of claim 10, wherein said bearing brackets are spaced laterally a predetermined distance from the other said vertical arm at each said end of said frame.

12. The calender of claim 1, 6 or 7, wherein said vertically immovable roller is the second roller from the bottom.

13. The calender of claims 1, 6 or 7, wherein a lower one of said horizontal rollers is a floating roller.

14. The calender of claim 12, comprising four horizontal rollers accommodated in said bracket means and arranged substantially in said one press plane, said four horizontal rollers including said at least two horizontal rollers; the uppermost of said four horizontal rollers being a floating roll.

15. The calender of claim 5, wherein the uppermost of said four horizontal rollers is a floating roller.

16. The calender of claim 14, wherein the upper two of said horizontal rollers have journals; and further comprising hanger means at each said end of said frame connecting said journals in such a manner that when the upper of said two upper rollers is lifted, the lower of two said upper rollers is also lifted.

17. The calender of claim 16, wherein said hangers are connected to said journals in such a manner as to remain out of contact with all rotating parts of said rollers when said uppermost roller is not in its lifted position.

* * * * *